US006318566B1

(12) United States Patent
Davis

(10) Patent No.: US 6,318,566 B1
(45) Date of Patent: Nov. 20, 2001

(54) SYSTEM FOR DISPLAYING COSMETIC PRODUCTS

(75) Inventor: Neil T. Davis, New York, NY (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/541,693

(22) Filed: Apr. 3, 2000

Related U.S. Application Data

(60) Provisional application No. 60/127,583, filed on Apr. 2, 1999.

(51) Int. Cl.[7] ..... B42F 17/00
(52) U.S. Cl. ..... 211/11
(58) Field of Search ..... 211/11, 10, 85.2, 211/13.1

(56) References Cited

U.S. PATENT DOCUMENTS

| | | | | |
|---|---|---|---|---|
| D. 169,455 | | 4/1953 | Revell . | |
| D. 206,562 | | 12/1966 | Lebedeff . | |
| D. 250,441 | | 12/1978 | Richman et al. . | |
| D. 315,994 | | 4/1991 | Bayley . | |
| D. 328,205 | | 7/1992 | Callon . | |
| D. 363,365 | | 10/1995 | Beaudoin et al. . | |
| D. 371,478 | | 7/1996 | Yates . | |
| D. 377,873 | | 2/1997 | Flötotto . | |
| D. 388,905 | | 1/1998 | Wells . | |
| D. 395,777 | | 7/1998 | Belokin et al. . | |
| D. 403,121 | | 12/1998 | Sussman . | |
| 727,107 | | 5/1903 | Donaldson . | |
| 1,600,830 | * | 9/1926 | Lewis . | |
| 3,173,386 | | 3/1965 | Magers . | |
| 3,313,513 | | 4/1967 | Howell . | |
| 3,413,053 | | 11/1968 | Featherston . | |
| 3,441,033 | * | 4/1969 | Flax . | |
| 3,543,943 | | 12/1970 | Joy et al. . | |
| 4,030,608 | | 6/1977 | Howard . | |
| 4,180,921 | | 1/1980 | Elbaum et al. . | |
| 4,216,867 | | 8/1980 | Sturm . | |
| 4,412,618 | * | 11/1983 | La Conte | 206/581 |
| 4,446,972 | * | 5/1984 | Sussman | 211/13.1 |
| 4,736,856 | | 4/1988 | Alneng et al. . | |
| 4,815,483 | * | 3/1989 | Du Grenier et al. | 132/295 |
| 4,898,281 | | 2/1990 | Cherry . | |
| 5,031,778 | * | 7/1991 | Edgecombe | 211/13.1 |
| 5,055,081 | | 10/1991 | Nayak . | |
| 5,322,024 | | 6/1994 | Avery et al. . | |
| 5,464,105 | | 11/1995 | Mandeltort . | |
| 5,623,881 | | 4/1997 | Huang . | |
| 5,913,312 | * | 6/1999 | Donnell | 132/73 |

* cited by examiner

*Primary Examiner*—Alvin Chin-Shue
*Assistant Examiner*—Sarah Purol
(74) *Attorney, Agent, or Firm*—Finnegan, Henderson, Farabow, Garrett & Dunner, L.L.P.

(57) ABSTRACT

A system for displaying cosmetic testers in a retail environment includes a display station having at least one surface with a plurality of holes therein. A plurality of display rails are provided. The display rails are configured to removably receive the cosmetic testers therein and have legs with end portions configured to removably fit in the holes so that the display rails are capable of being rearranged on the surface to modify display of the cosmetic products. The system further includes at least one application play station having at least one application station rail thereon. The application station rail retains additional testers. In a preferred embodiment, the application station rail is removably mounted on the application play station, and the display station includes a display tower having rotatable tiers.

35 Claims, 17 Drawing Sheets

FIG. 11
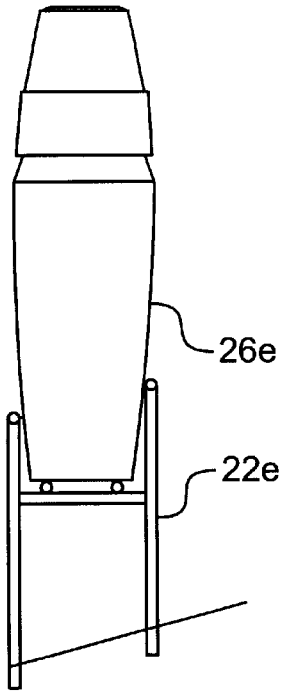
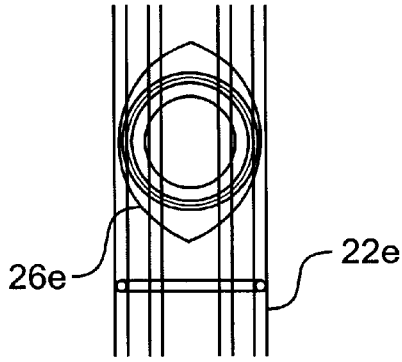
FIG. 12
FIG. 13
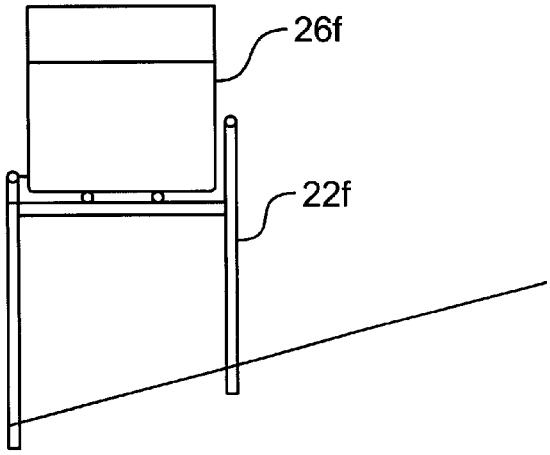
FIG. 14
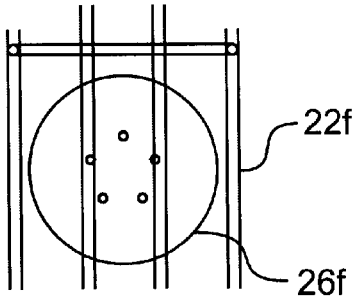

FIG. 20
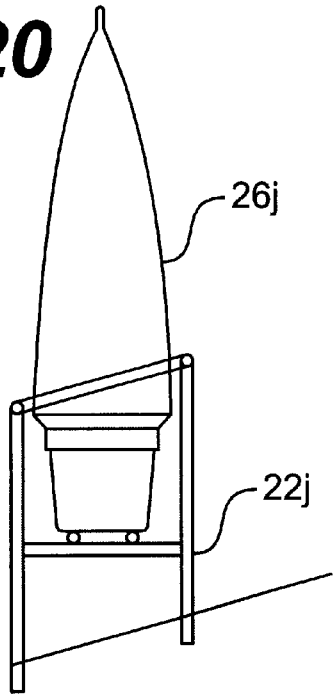
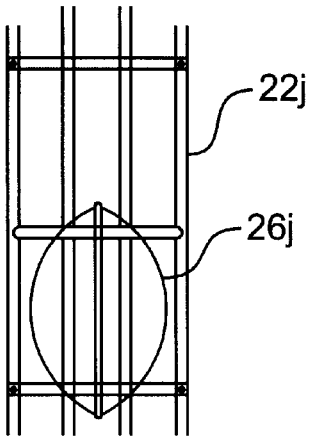
FIG. 21
FIG. 22
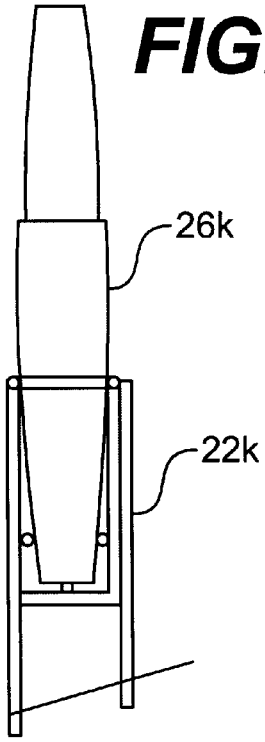
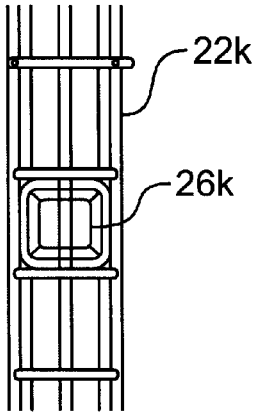
FIG. 23

SYSTEM FOR DISPLAYING COSMETIC PRODUCTS

This application relies on the benefit of priority of U.S. provisional patent application Serial No. 60/127,583, filed Apr. 2, 1999.

BACKGROUND OF THE INVENTION

1. Field of the Invention

The present invention relates to a system for displaying cosmetic products in a retail environment. In particular, the present invention relates to a display including cosmetic rails capable of being rearranged to modify the display, as well as cosmetic testers that can be individually removed from and replaced on the rails by sales consultants and consumers.

2. Description of Related Art

Cosmetic products are sold in a variety of different retail environments. The most common retail setting (i.e., a discount store) includes shelves storing hundreds of different products with almost no provision being made for facilitating testing of the products by the customers. In addition, these types of retail environments normally have very few, if any, sales assistants knowledgeable about the various cosmetic products. Although this is acceptable to some budget conscious consumers, there are a significant number of consumers who demand a more "upscale" retail environment that provides testing of various types of cosmetic products and the assistance of a staff of trained cosmetic consultant. Such a sales environment is present in a number of department stores and specialty cosmetic stores, but there are a number of different drawbacks and disadvantages associated with these conventional approaches.

Many "upscale" color cosmetic displays have fixed product modules that are difficult or impossible to rearrange or remove. This presents a problem over the course of a year when there are changes in the product lineup, such as products being discontinued or new products (or shades) being introduced. Also, sales consultants and consumers are obligated to test makeup products right at the display because they are stationary and the module/tester can not be removed and replaced. Relatively fixed displays may also make it difficult for a consumer to access a number of different types of cosmetic products simultaneously without having to move to different areas of a cosmetics counter.

Although some retail stores now have testing areas with various colors, shades and tones of particular types of cosmetics mounted on a display element, the individual cosmetic testers normally cannot be removed from these display elements. This renders it impossible to select a small group of products from a larger one, for example, for testing at a different location.

Customer crowding is another drawback associated with conventional retail environments for cosmetic products. This problem stems from the arrangement of testing areas in the same area where cosmetics are being displayed. Customers experimenting with various types of cosmetic products can obstruct the access of other customers in search of cosmetics displayed in the same general area.

In light of the foregoing, there is a need for an improved display for cosmetic products.

SUMMARY OF THE INVENTION

Accordingly, the present invention is directed to a display that substantially obviates one or more of the limitations of the related art. To achieve these and other advantages and in accordance with the purposes of the invention, as embodied and broadly described herein, the invention includes a system for displaying cosmetic products in a retail environment. The system comprises a display station including at least one surface having a plurality of holes therein. A plurality of display rails are provided. The display rails are configured to removably receive the cosmetic products thereon and have legs with end portions configured to removably fit in the holes so that the display racks are capable of being rearranged on the surface to modify display of the cosmetic products. The system further comprises at least one application play station at which the cosmetic products removed from the display rails can be applied. In a preferred embodiment, there are two application play stations that can accommodate many sales consultants and consumers testing cosmetic products. Preferably, there is at least one mirror provided on the application play station(s) to permit evaluation of cosmetic products applied at the application play station(s).

In an aspect of the invention, the application play station includes at least one surface having a plurality of holes therein. An application station rail is provided with legs having end portions configured to removably fit in the holes in the surface of the application station.

In another aspect of the invention, portable trays are provided to facilitate transfer of the cosmetic products from the display station to the application station(s).

In yet another aspect of the invention, the system includes a shelving unit (an open sell unit, for example) including a plurality of shelves having holes therein, and a plurality of shelving rails configured to removably receive the cosmetic products therein. Preferably, the shelving rails have legs with end portions configured to removably fit in the holes in the shelves.

In a further aspect, the present invention includes a system comprising a display tower provided on a display station. The display tower preferably includes a plurality of rotatable tiers, each having at least one tower rail configured to removably receive cosmetic products, such as various lip cosmetics, therein. In a preferred embodiment, each tier is independently rotatable.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate an embodiment of the invention and, together with the description, serve to explain the principles of the invention. In the drawings.

FIG. 11 is a side view of a rail for a foundation tester;

FIG. 12 is a partially schematic top view of the rail of FIG. 11;

FIG. 13 is a side view of a rail for a loose powder tester;

FIG. 14 is a partially schematic top view of the rail of FIG. 13;

FIG. 20 is a side view of a rail for a tubular shaped container (e.g. for color fitness);

FIG. 21 is a partially schematic top view of the rail of FIG. 20;

FIG. 22 is a side view of a rail for a large mascara dispenser (e.g., for generous mascara);

FIG. 23 is a partially schematic top view of the rail of FIG. 22;

DESCRIPTION OF THE PREFERRED EMBODIMENT

Figure 1:
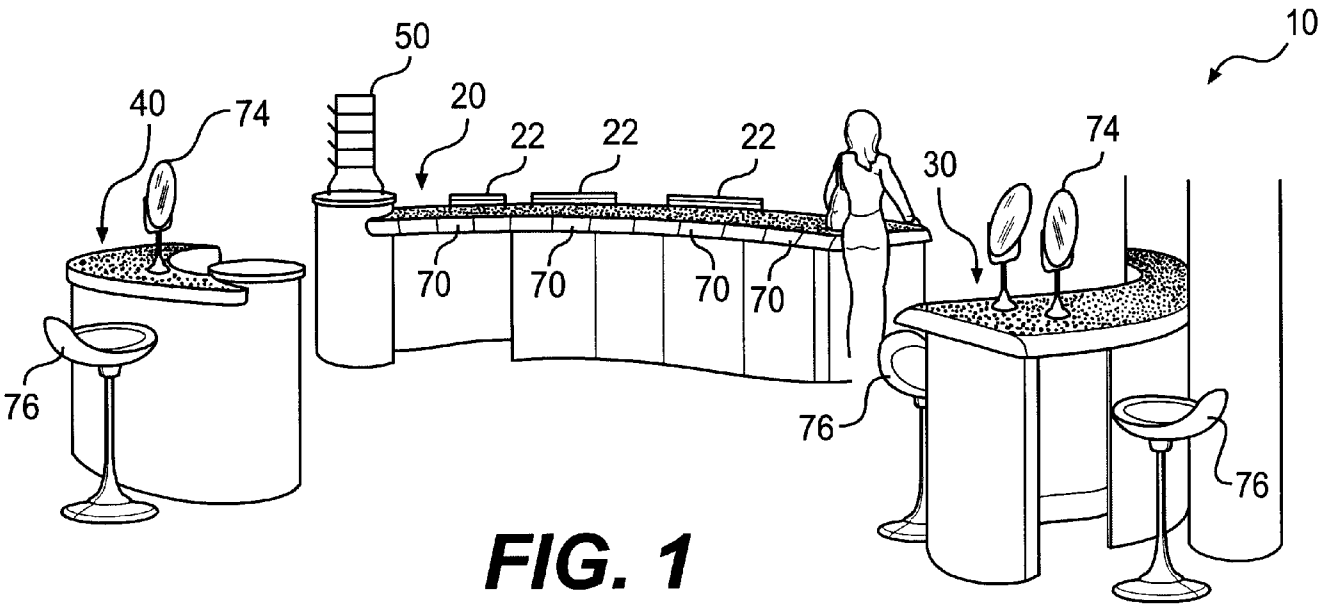
FIG. 1 is a perspective view of a cosmetic display system in accordance with the preferred embodiment of the invention.

Reference will now be made in detail to the present preferred embodiment of the invention, an example of which is illustrated in the accompanying drawings. Wherever possible, the same reference numbers are used in the drawings and the description to refer to the same or like parts. In addition, reference numerals having different alphabetic suffixes are used to refer to similar parts.

FIG. 1 shows an embodiment of a system 10 for displaying cosmetic products in a retail environment, such as a cosmetic sales area of a department store or a specialty store carrying cosmetics, for example. The preferred embodiment of the system 10 includes a display station 20, a first application play station 30, and a second application play station 40. In general, the display station 20 is preferably configured to display a vast array of different types of cosmetic product testers and the application play stations 30 and 40 are preferably configured to permit test application of particular cosmetic products selected at the display station 20. The application play stations 30 and 40 are preferably separate from the display station 20 to permit consumers to test cosmetics in an area located away from the immediate area where cosmetic products are being displayed.

A plurality of display rails 22 are provided on the display station 20. (As used herein, the term "display rail" generally refers to a rack, which is preferably made of elongated members such as wire.) The display rails 22 are configured to removably receive a plurality of the cosmetic product testers therein, and to allow customers to remove the cosmetic products from the display rails 22. The display rails 22 are also preferably arranged to permit store personnel to restock the display rails 22.

Figure 2:
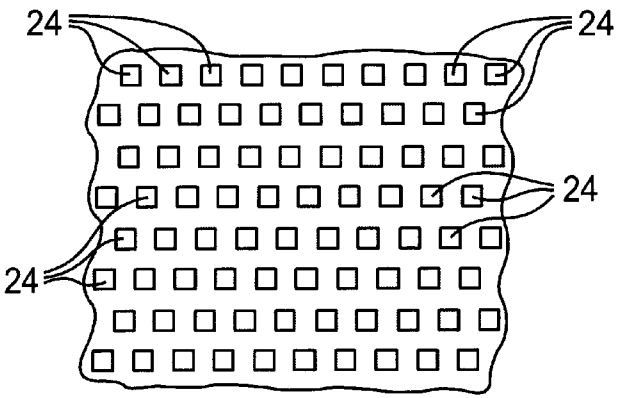
FIG. 2 is a detailed view of holes provided in upper surfaces of a display station and application play stations shown in FIG. 1.

In the preferred embodiment, the display station 20 and the display rails 22 are configured to permit rearrangement of the display rails 22 on the display station 20 to modify the display of cosmetic products on the display station 20. As shown in FIG. 2, at least one upper surface of the display station 20 includes a plurality of holes 24 therein. The display rails 22 have legs with end portions configured to removably fit in the holes 24. This structural arrangement permits a particular display rail 22 to be mounted at a variety of different locations on the display station 20.

The holes 24 could have different shapes and could be arranged in any particular fashion. In the example shown in FIG. 2, the holes 24 are square shaped and are arranged in substantially parallel rows.

Preferably, there are a variety of different types of display rails 22 capable of being mounted on the display station 20. Each type of display rail 22 is preferably configured to removably retain a different type of cosmetic product therein.

Figure 3:
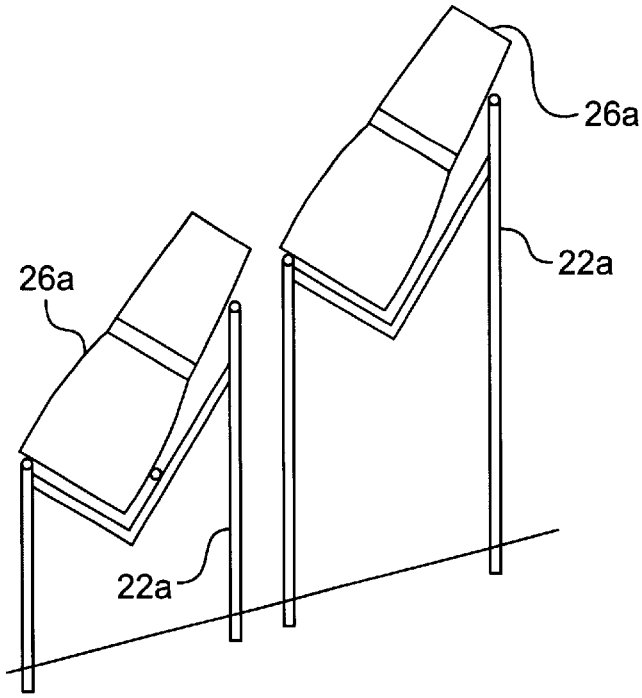
FIG. 3 is a side view of display racks for nail polish tester bottles.
Figure 4:
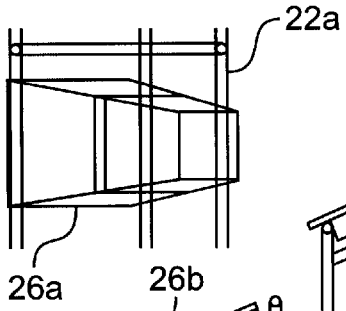
FIG. 4 is a partially schematic top view of one of the rails of FIG. 3.
Figure 5:
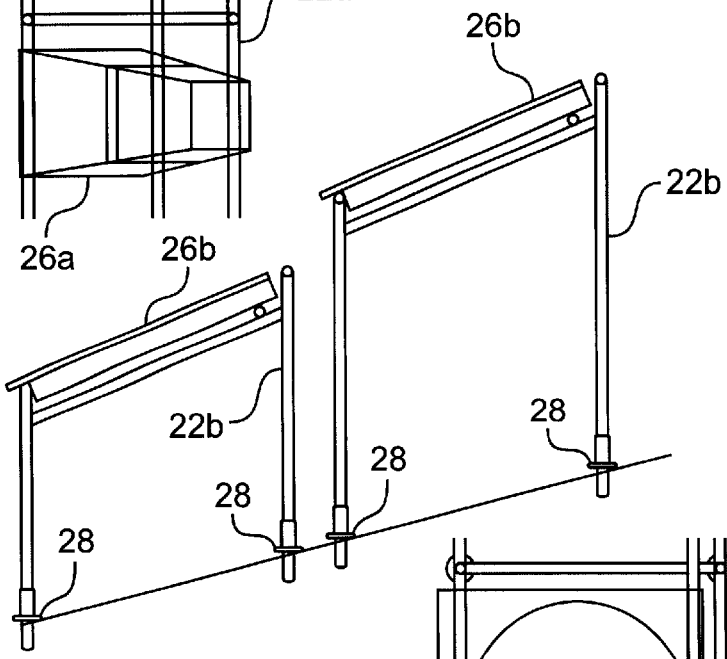
FIG. 5 is a side view of a display rails for cosmetic testers with rounded recesses (e.g., for containing powder or concealer)
Figure 6:
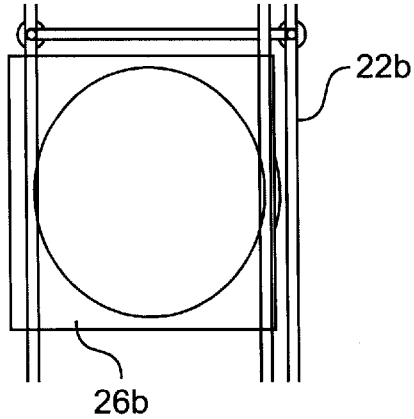
FIG. 6 is a partially schematic top view of one of the rails of FIG. 5.
Figure 7:
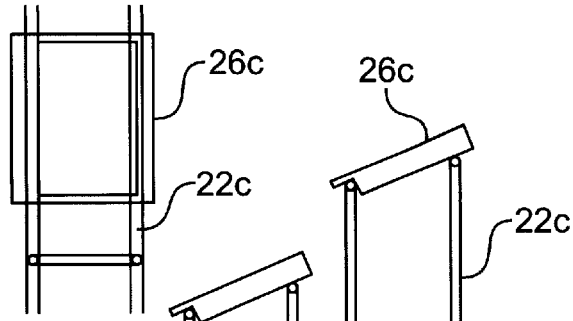
FIG. 7 is a partially schematic top view of a rack for a rectangular cosmetic tester (e.g., for containing eye shadow)
Figure 8:
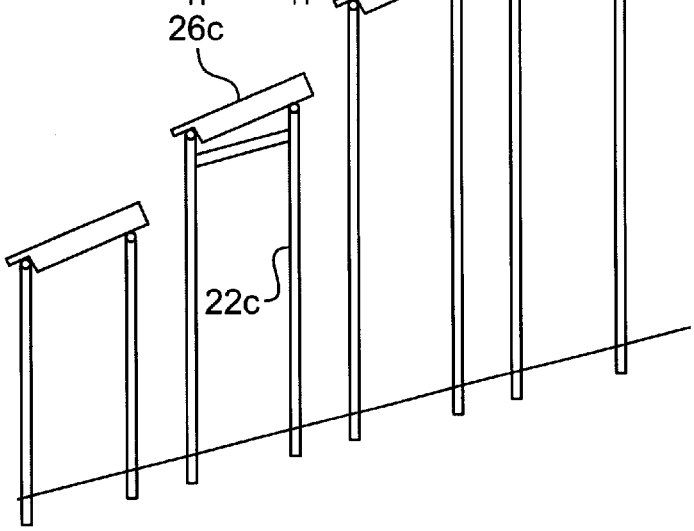
FIG. 8 is a side view of a plurality of rails like the rail of FIG. 7.
Figure 9:
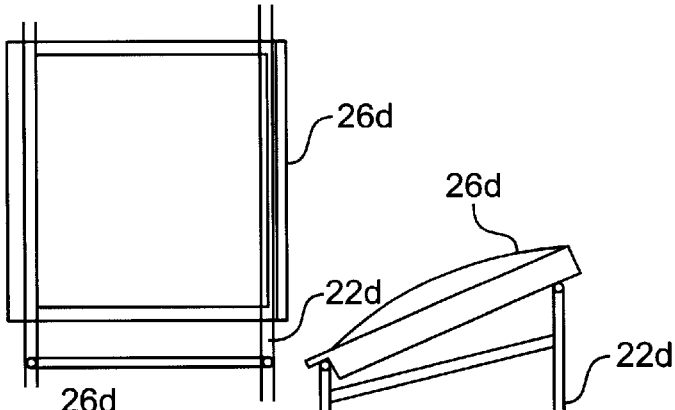
FIG. 9 is a partially schematic top view of a rack for a large cosmetic pan (e.g., for makeup)
Figure 10:
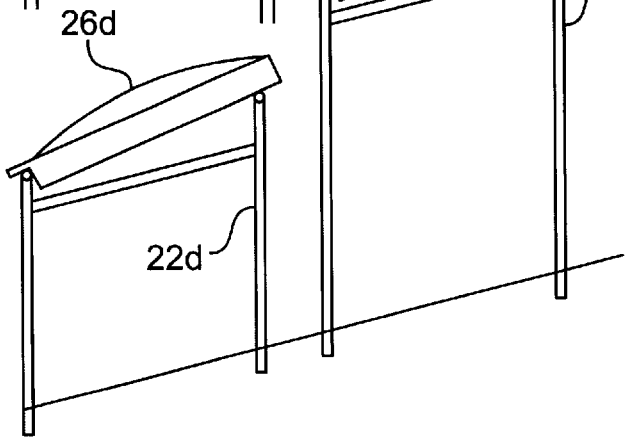
FIG. 10 is a side view of a plurality of rails like the rail of FIG. 9.
Figure 15:
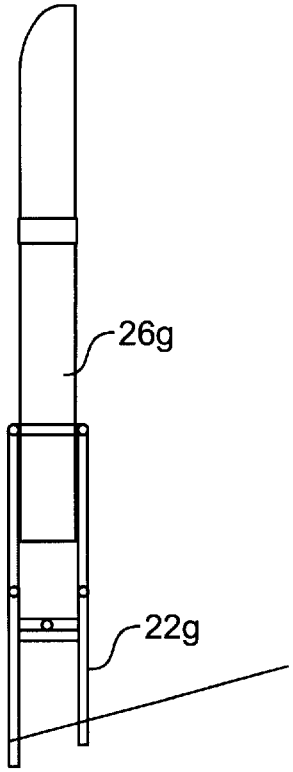
FIG. 15 is a side view of a rail for a mascara tester.
Figure 16:
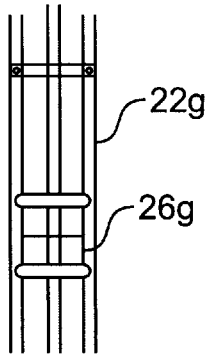
FIG. 16 is a partially schematic top view of the rail of FIG. 15.
Figure 17:
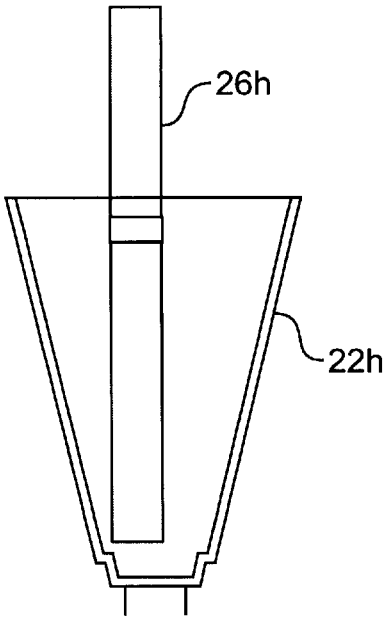
FIG. 17 is a partially schematic view of a holder for a vertical tester.
Figure 18:
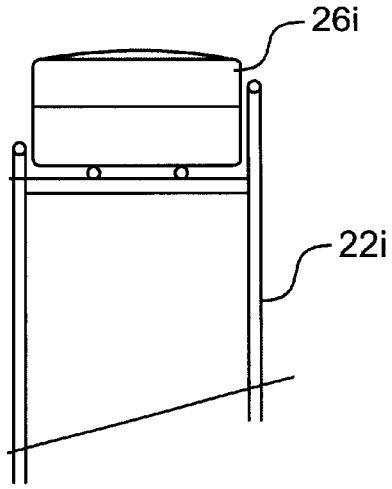
FIG. 18 is a side view of a rail for a cylindrical tester container (e.g., for just cheeks)
Figure 19:
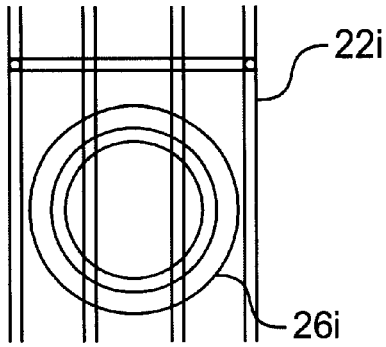
FIG. 19 is a partially schematic top view of the rail of FIG. 18.

FIGS. 3 and 4 show an example of display rails 22*a* configured to removably receive nail polish containers 26*a*. FIGS. 5 and 6 show an example of display rails 22*b* configured to removably receive pans 26*b* including a rounded recess containing blush, concealer, or another cosmetic. FIGS. 7–8 and 9–10 show examples of display racks 22*c* and 22*d* configured to removably receive rectangular pans 26*c* and relatively large pans 26*d*, both containing powder, blush, or another cosmetic. FIGS. 11 and 12 show an example of a display rail 22*e* configured to removably receive foundation testers 26*e*. FIGS. 13 and 14 show an example of a display rail 22*f* configured to removably receive loose powder testers 26*f*. FIGS. 15 and 16 show an example of a display rail 22*g* configured to removably receive mascara dispensers 26*g*. FIGS. 17 shows an example of a cup-shaped display rail 22*h* configured to removably receive a vertical tester 26*h*. FIGS. 18 and 19 show an example of a display rail 22*i* configured to removably receive generally cylindrical containers 26*i* containing a cosmetic, such as cheek coloring. FIGS. 20 and 21 show an example of a display rail 22*j* configured to removably receive generally tubular shaped containers 26*j* having flexible walls. FIGS. 22 and 23 show an example of a display rail 22*k* configured to removably receive relatively large mascara dispensers 26*k*.

As shown in FIG. 5, stops 28 are preferably mounted on the legs of rails 22*b*. Stops 28 are also preferably mounted on the legs of rails 22*a*, 22*c*–22*g*, and 22*i*–22*k*. The stops 28 limit the extent to which the end portions of the legs pass through the holes 24 shown in FIG. 2. For example, the stops 28 could be washer-shaped structures mounted on the rail legs.

Figure 24:
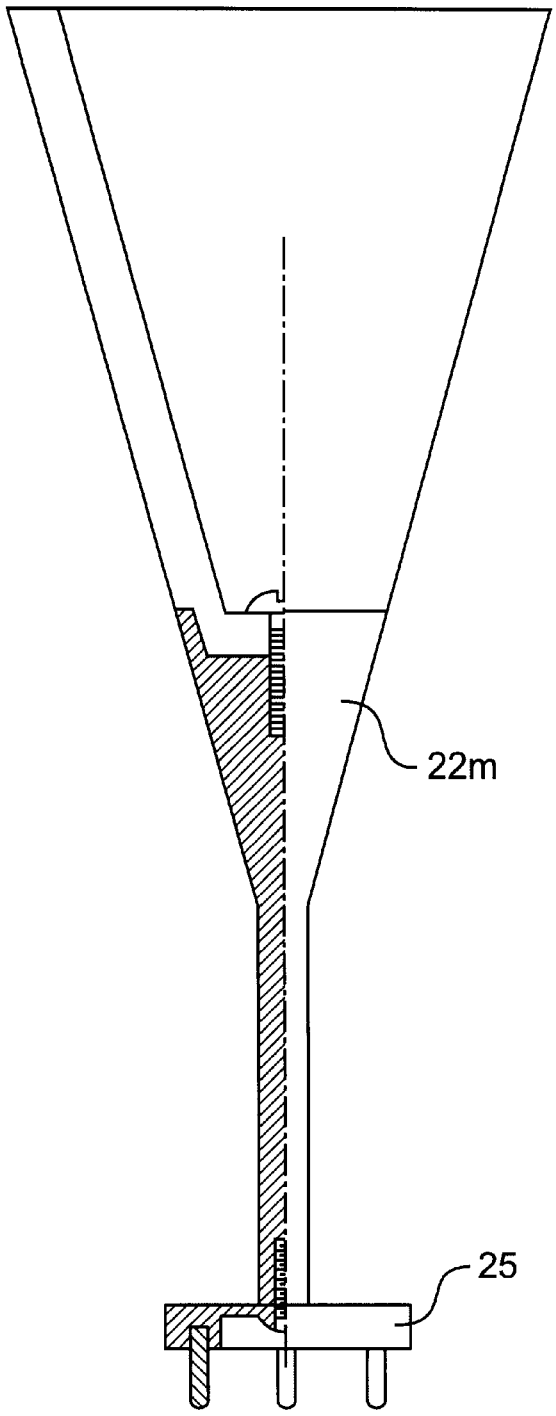
FIG. 24 is a partial cross-section view of a cup for receiving eye pencils.

Other types of objects could also be removably mounted in the holes 24 on the display station 20. For example, mirror frames or sign holders could be removably mounted on the station 20. In addition, a cup-shaped holder 22*m*, shown in FIG. 24, could be removably mounted on the display station 20. The cup-shaped holder 22*m* is configured to removably receive eye pencils therein and includes a base 25 permitting pivoting of the holder 22*m* with respect to the display station 20.

Figure 25:
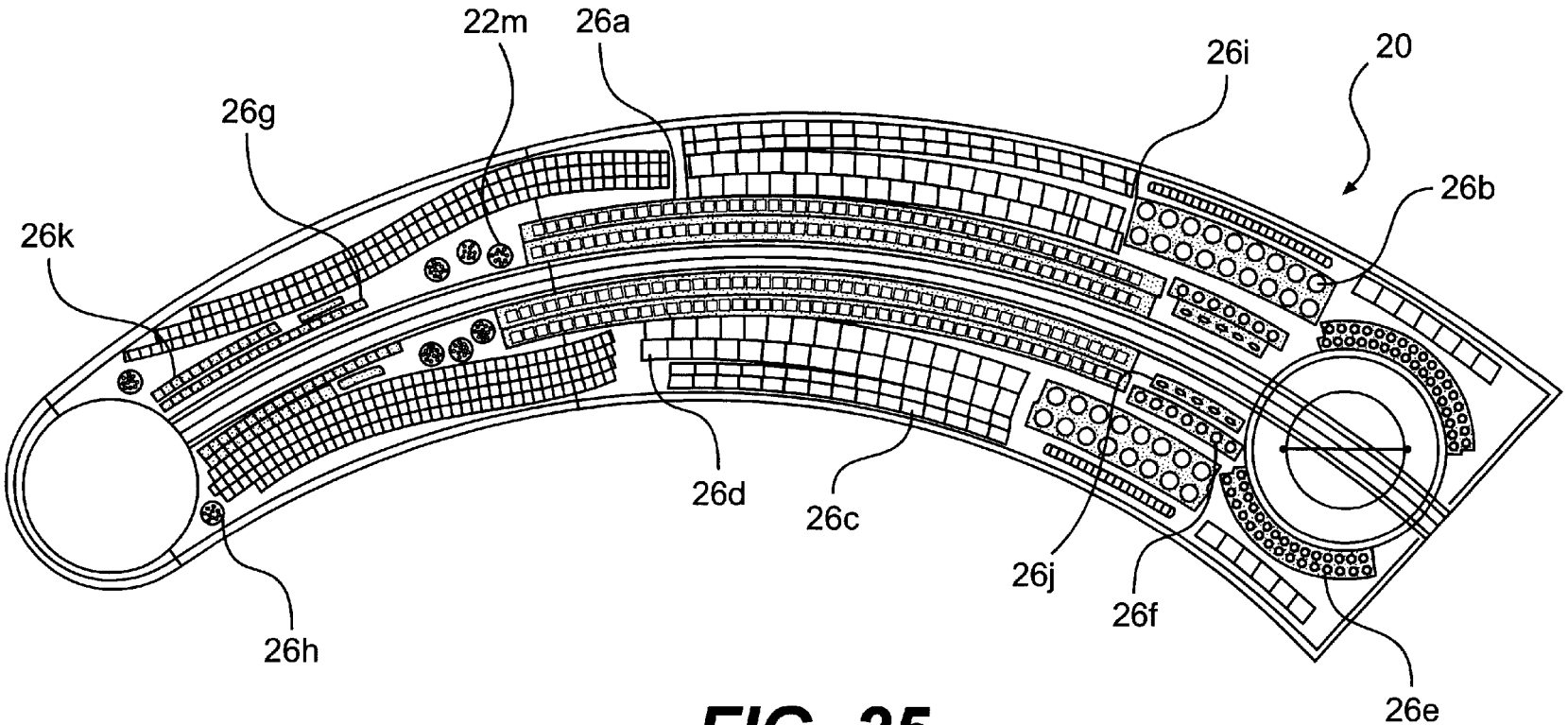
FIG. 25 is a top view of the display station of FIG. 1 showing an arrangement of the rails of FIGS. 3–23.

FIG. 25 shows one example of how the rails 22*a*–22*k* and holder 22*m* could be arranged on the upper surface of the display station 20 to display the cosmetic products 26*a*–26*k*. Because the rails 22*a*–22*k* and holder 22*m* removably fit in the holes (FIG. 2) on the display station 20, there are numerous ways in which the rails 22*a*–22*k* and holder 22*m* could be placed on the display station 20 to reconfigure the way in which the cosmetic products 26*a*–26*k* are displayed.

Preferably, the rails 22*a*–22*g* and 22*i*–22*k* are elongated so that each rail 22*a*–22*g* and 22*i*–22*k* carries a row of respective cosmetic products 26*a*–26*g* and 26*i*–26*k*. At least some of the rails 22*a*–22*g* and 22*i*–22*k* (for example, the rails 22*a*–22*f*, 22*i*, 22*j*) are preferably configured with one or more elongated members (e.g. wires) along their length to permit the respective cosmetic products 26*a*–26*g* and 26*i*–26*k* to slide along the length of rails 22*a*–22*g* and 22*i*–22*k* during rearrangement or loading of the respective cosmetic products 26*a*–26*g* and 26*i*–26*k* therein. Similar types of rails 22*a*–22*g* and 22*i*–22*k* could be placed next to one another to elongate a row in which respective cosmetic products 26*a*–26*g* and 26*i*–26*k* are displayed. In addition, at least some of the rails 22*a*–22*g* and 22*i*–22*k* are preferably curved along their length to create an attractive display.

In the preferred embodiment, each individual cosmetic product 26*a*–26*k* is removable from its respective display rail 22*a*–22*k* for testing at one of the application play stations 30, 40 shown in FIG. 1. This is in contrast to some conventional cosmetic displays where groups of different individual cosmetic products, such as cosmetic products having different colors or shades, are permanently mounted on a common display element that cannot be removed from a display.

Figure 26:
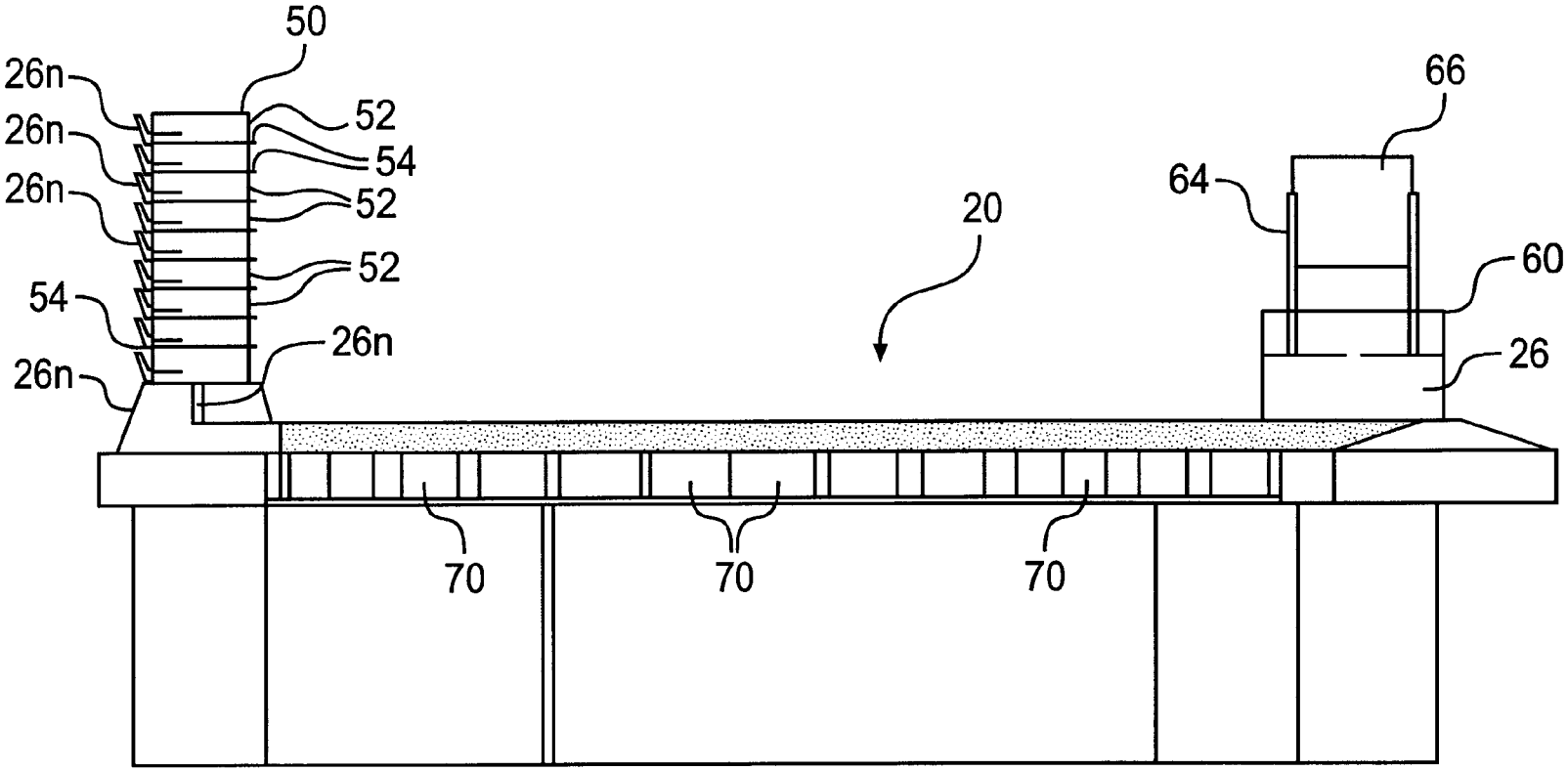
FIG. 26 is a front view of the display station of FIG. 1.

As shown in FIG. 26, a display tower 50 and a display cabinet 60 are preferably provided on the upper surface of the display station 20. In the preferred embodiment, the display tower 50 includes a plurality of independently rotatably tiers 52. Each of the tiers 52 preferably has a rail 54 (i.e., a wire rack) configured to removably receive cosmetic products, such as lipsticks and lip glosses. The rails 54 preferably surround each of the tiers 52 so that lipstick testers 26*n* containing differing colors or shades of lipstick can be displayed during rotation of each of the tiers 52.

The display cabinet 60 is preferably shaped similar to a layered "wedding cake." An interior of the display cabinet 60 has a hollow area for housing product displays and one or more walls 62 on the cabinet 60 is at least partially transparent to permit viewing of the product display in the interior. Preferably, at least one of the walls 62 is movably mounted or removably mounted to permit changing of the products in the interior. Optionally, the display cabinet 60 includes a frame 64 for holding a sign 66.

Figure 27:
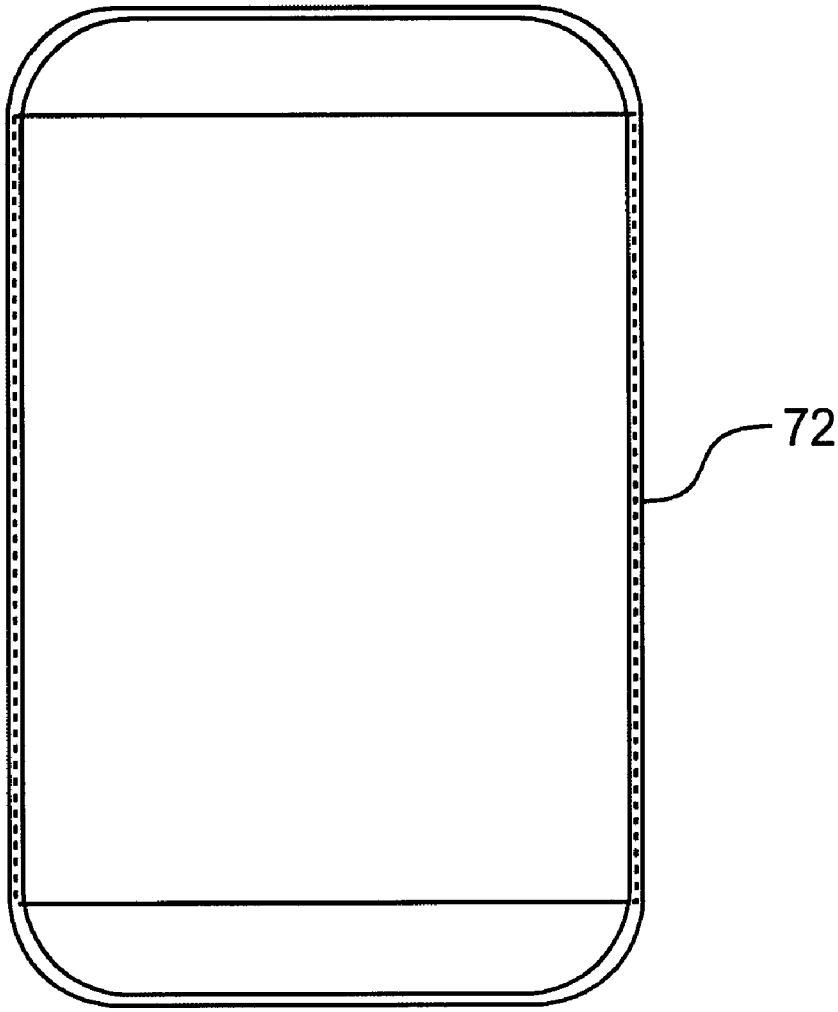
FIG. 27 is a top view of a tray for transporting cosmetic products between the display station and one of the application play stations shown in FIG. 1.

Preferably, tray storage compartments 70 are provided along the outer periphery of the display station 20. Each tray storage compartment 70 is sized to contain one or more portable trays, such as the portable tray 72 shown in FIG. 27. The trays 72 are configured to place cosmetic products thereon to facilitate transfer of the cosmetic testers from the display station 20 to one of the application play stations 30, 40 shown in FIG. 1.

Figure 28:
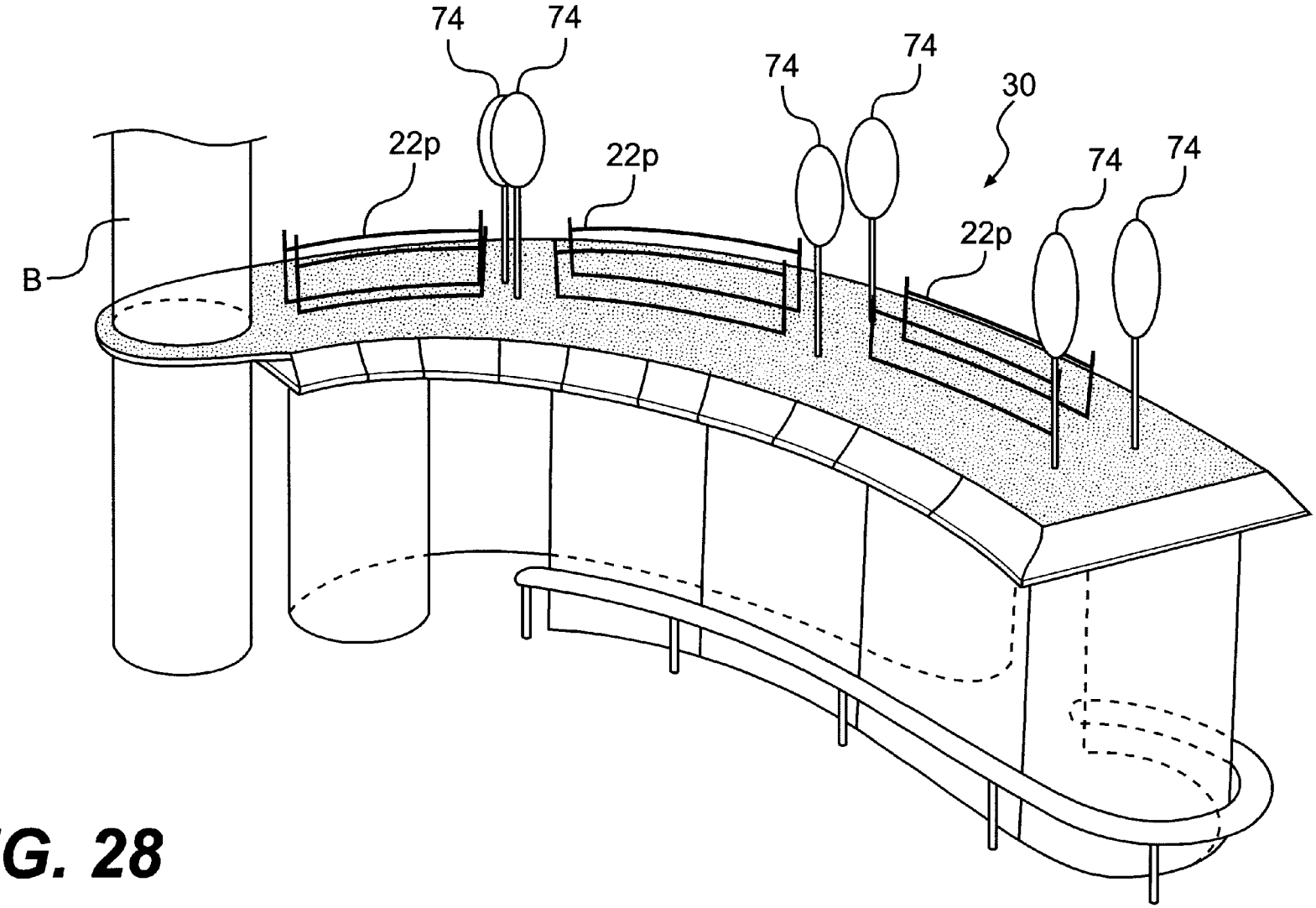
FIG. 28 is a perspective view of a first application play station shown in FIG. 1.
Figure 29:
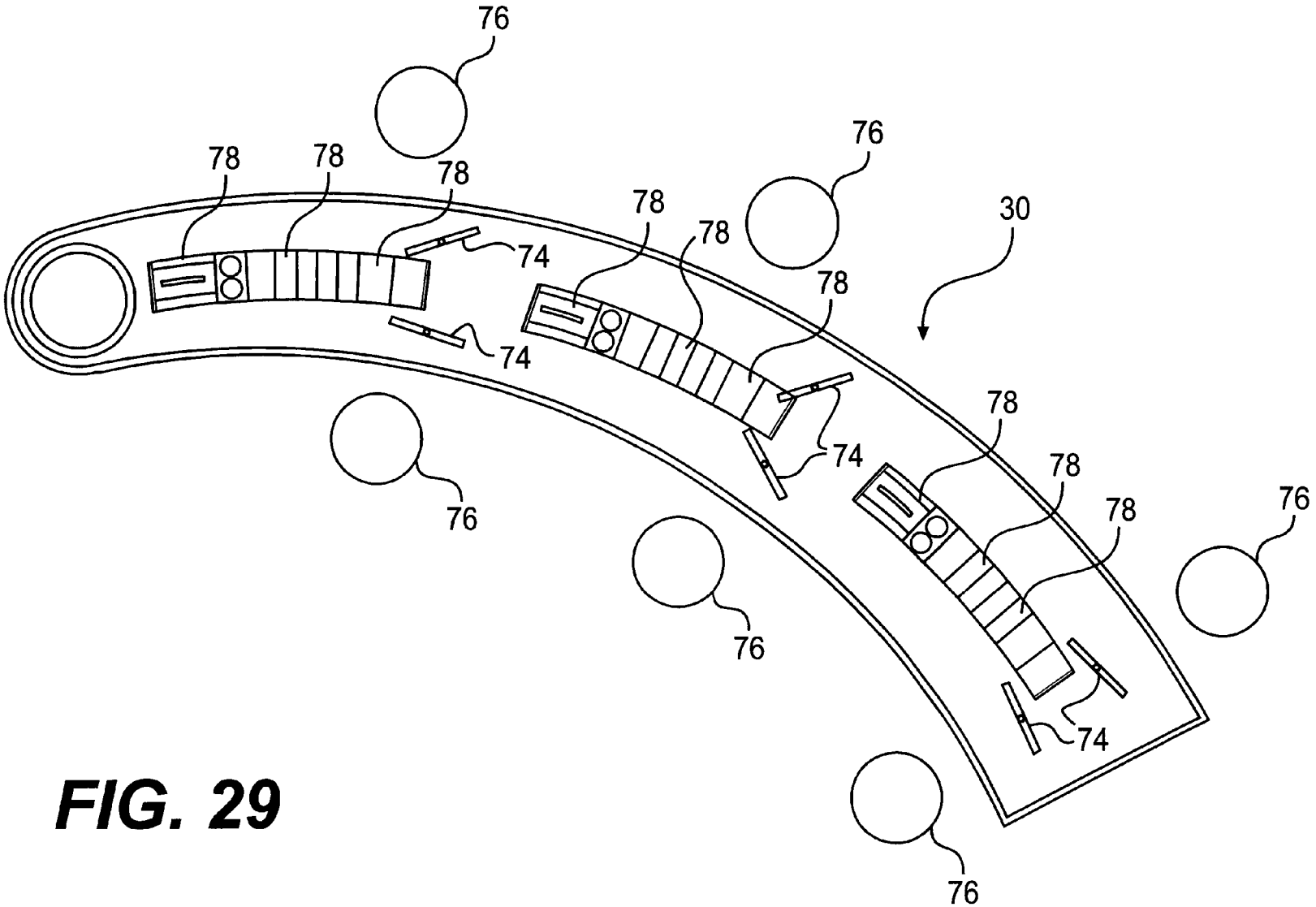
FIG. 29 is a top view of the application play station of FIG. 28.

FIGS. 28 and 29 show details of the preferred construction for the first application play station 30. Preferably, one or more rails 22*p* are provided on the upper surface of the application play station 30 to removably retain additional cosmetic testers, such as foundation testers. To permit rearrangement of the rails 22*p*, the upper surface of the application station 30 preferably has holes like the holes 54 shown in FIG. 2, for example, and the rails 22*p* have legs with end portions configured to removably fit in these holes.

One or more mirrors 74 are mounted on the upper surface of the application play station 30. Preferably, each of the mirrors 74 is mounted in a lighted frame. The mirrors 74 allow individuals to evaluate cosmetic products applied at the application play station 30. As shown in FIG. 28, an end portion of the application play station 30 is preferably configured to surround a building column B to provide attractiveness.

As shown in FIG. 29, a plurality of seats 76, such as stools or chairs, are provided adjacent to the application play station 30 to permit a number of customers to be seated during application of cosmetic products at the application play station 30. For example, the seats 76 could be secured to the floor in a store. Preferably, the top surface of the application play station 30 is substantially flat to allow for placement of the tray 72 (FIG. 27) thereon after the tray 72 loaded with cosmetics is delivered from the display station 20.

Figure 30:
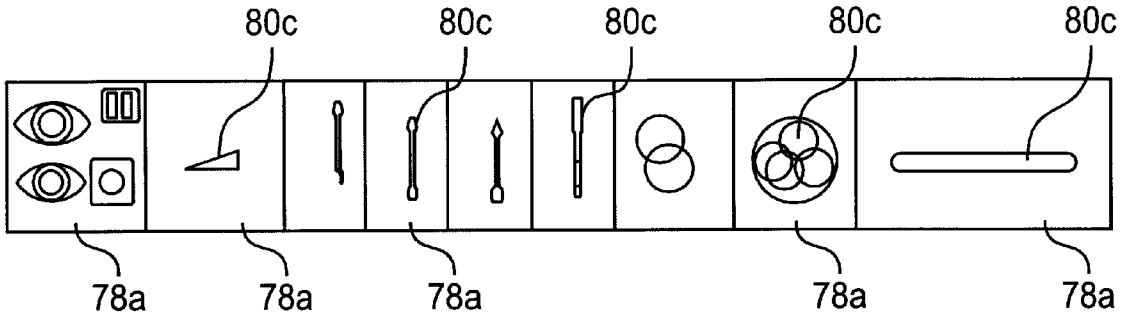
FIG. 30 is a top view of a compartment arrangement for the application play station of FIGS. 28 and 29.
Figure 31:
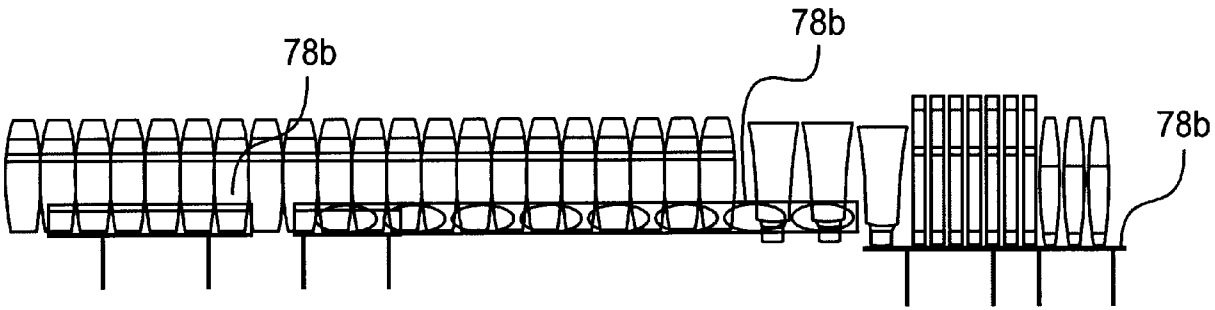
FIG. 31 is a side view of a rail arrangement for the application play station of FIGS. 28 and 29.
Figure 32:
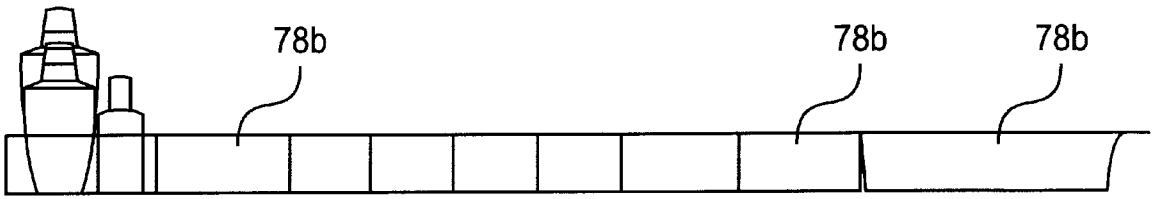
FIG. 32 is a top view of a second rail arrangement for the application play station of FIGS. 28 and 29.

A middle portion of the application play station 30 preferably includes at least one well containing one or more compartments 78 to house makeover supplies. FIGS. 30–32 show alternative configurations of the compartments 78. With the arrangement shown in FIG. 30, compartments 78*a* each have an opening and are configured to dispense a particular type of applicator, such as a swab 80*a*, cotton balls 80*b*, foundation sponges 80*c*, brushes 80*d*, tissue 80*e*, etc. With the arrangement shown in FIG. 31, compartments 78*b* are configured like rails to removably retain various types of additional testers. With the arrangement shown in FIG. 32, compartments 78*c* are recesses configured to removably retain makeover supplies, therein.

Figure 33:
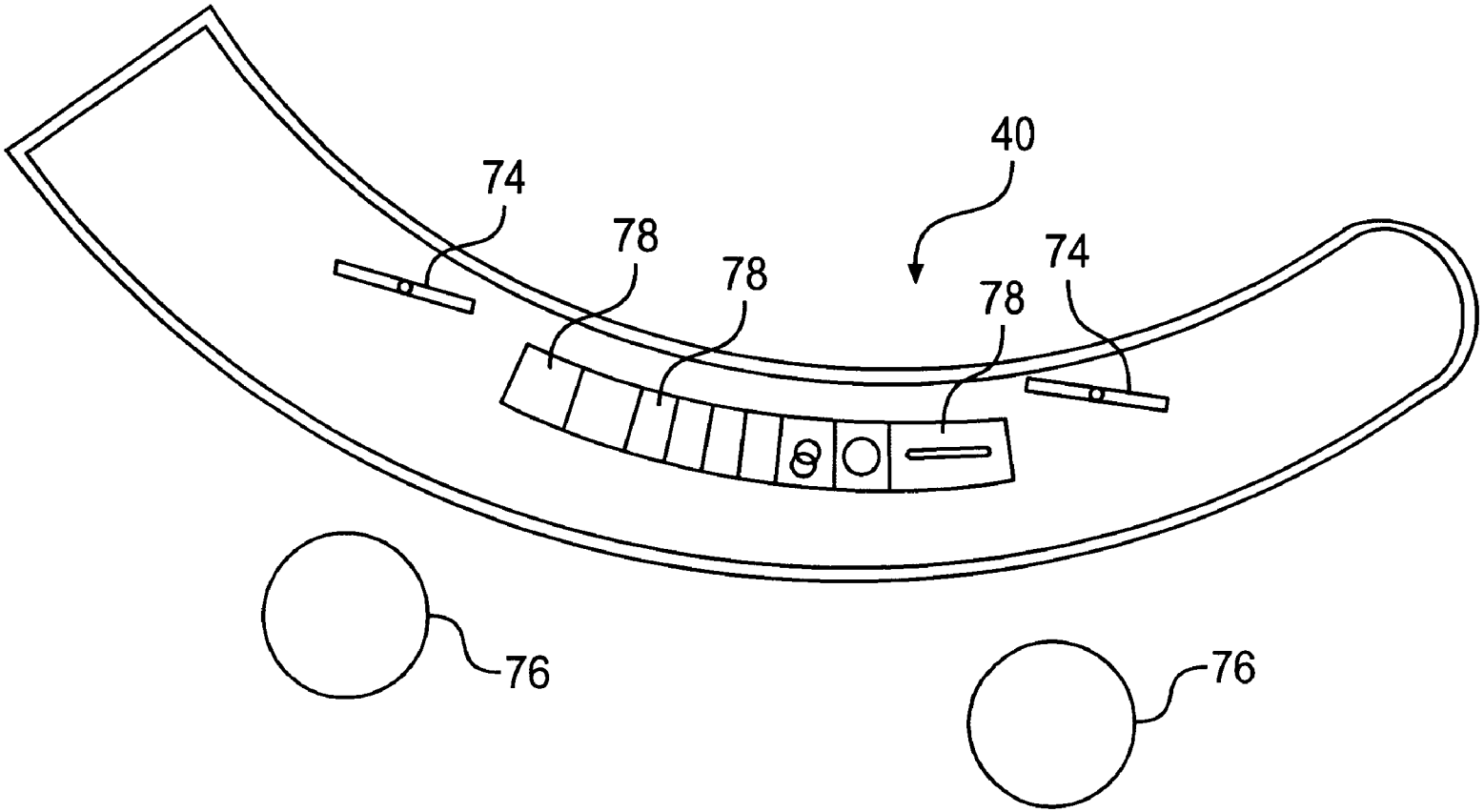
FIG. 33 is a top view of a second application play station shown in FIG. 1.

FIG. 33 shows a top view of the optional second application play station 40. Preferably, the second application play station 40 is constructed similar to the first application play station 30. For example, the second application play station 40 preferably includes holes like those shown in FIG. 2 and removable rails.

Figure 34:
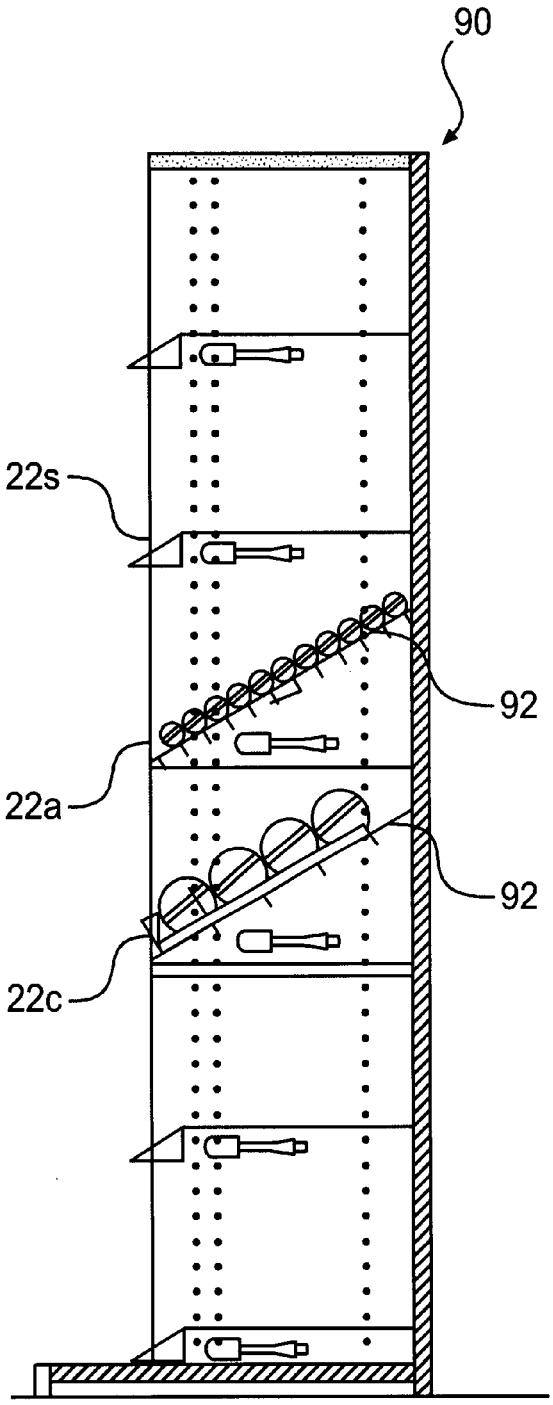
FIG. 34 is a cross-section view of the open sell shelving unit for the system of FIG. 1.

FIG. 34 shows a preferred embodiment of an open sell shelving unit 90 for use with the system. Shelves 92, which are removably mounted in the shelving unit 90, include a plurality of holes (like the holes 24 shown in FIG. 2, for example) for removably receiving legs of rails 22*q* and 22*r*.

Figure 35:
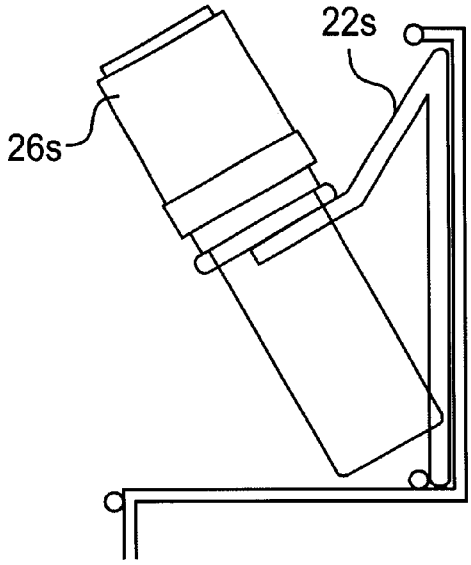
FIG. 35 is a side view of a lipstick rail for the shelving unit of FIG. 34.
Figure 36:
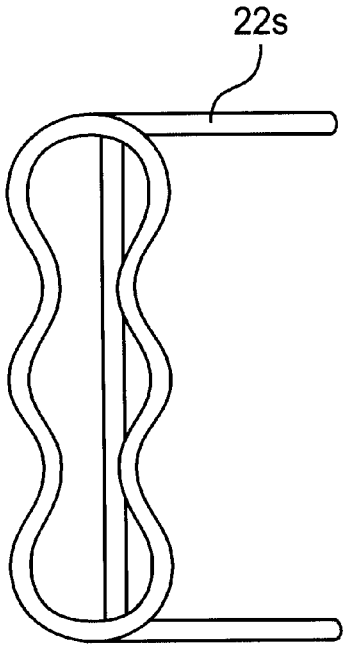
FIG. 36 is a front view of the rail of FIG. 35.

Rails 22*s* shown in FIGS. 34–36 may also be provided on the shelving unit 90 for housing removable testers 26*s,* such as lipstick.

It will be apparent to those skilled in the art that various modifications and variations can be made to the structure of the present invention without departing from the scope or spirit of the invention. For example, the invention could still be practiced without having one or more components of the system, such as one or more of the application play stations or the open sell shelving unit. In view of the foregoing, it is intended that the present invention cover modifications and variations of this invention provided they fall within the scope of the following claims and their equivalents.

What is claimed is:

1. A system for displaying cosmetic products in a retail environment, comprising:

a display station including at least one surface having a plurality of holes therein;

a plurality of display rails configured to removably receive the cosmetic products therein, the display rails having legs with end portions configured to removably fit in the holes so that the display rails are capable of being rearranged on the surface to modify display of the cosmetic products; and at least one application play station at which cosmetic products removed from the display rails may be applied, the application play station including at least one mirror arranged to permit evaluation of the cosmetic products applied at the application play station.

2. The cosmetic display system of claim 1, wherein said application play station includes at least one surface having a plurality of holes therein, and wherein said system includes at least one application station rail configured to removably receive cosmetic products therein, the application station rail including legs having end portions configured to removably fit in the holes in the surface of the application play station.

3. The cosmetic display system of claim 1, wherein said at least one application play station includes a first application play station and a second application play station.

4. The cosmetic display system of claim 1, wherein the display station includes at least one tray storage compartment and at least one portable tray provided in the compartment, the tray being configured for placement of cosmetic products thereon to facilitate transfer of the cosmetic products from the display station to the application play station.

5. The cosmetic display system of claim 1, further comprising a plurality of cosmetic products removably mounted in the plurality of display rails.

6. The cosmetic display system of claim 5, wherein the cosmetic products are chosen from nail polish, eye shadow, foundation bottles, powder dispensers, mascara dispensers, eyeliner dispensers, eye pencils, lipsticks, lip glosses, cheek color, and concealer.

7. The cosmetic display system of claim 1, wherein the plurality of display rails include at least one rail configured to removably receive at least one of nail polish testers, eye shadow testers, foundation testers, powder dispensers, mascara dispensers, eyeliner dispensers, eye pencils, lipsticks, lip glosses, cheek color, and concealer.

8. The cosmetic display system of claim 1, further comprising a display tower provided on the display station, the display tower including a plurality of rotatable tiers, each of the tiers having at least one rail configured to removably receive cosmetic products therein.

9. The cosmetic display system of claim 8, further comprising lip cosmetics removably mounted in the rails on the tiers.

10. The cosmetic display system of claim 8, wherein each of the rotatable tiers is independently rotatable.

11. The cosmetic display system of claim 1, further comprising a product display cabinet mounted on the display station, the display cabinet having at least one wall formed of at least partially transparent material to permit viewing of objects in the display cabinet.

12. The cosmetic display station of claim 1, further comprising a cup-shaped holder mounted on the surface of the display station, the cup-shaped holder being configured to removably receive pencils therein.

13. The cosmetic display system of claim 1, wherein the at least one mirror is mounted on the application play station.

14. The cosmetic display system of claim 1, comprising at least one seat adjacent to the application play station, for permitting an individual to be seated during application of cosmetic products at the application play station.

15. The cosmetic display system of claim 1, wherein the application play station includes a plurality of compartments each having an opening, for dispensing at least one of applicators, cotton balls, and tissues.

16. The cosmetic display system of claim 1, wherein the application play station has an end portion configured to surround a building column.

17. The cosmetic display system of claim 1, further comprising an open sell shelving unit including a plurality of shelves having holes therein, and a plurality of shelving rails configured to removably receive the cosmetic products, the shelving rails having legs with end portions configured to removably fit in the holes in the shelves.

18. A system for displaying cosmetic products in a retail environment, comprising:

a display station including at least one surface having a plurality of holes therein;

a plurality of display rails configured to removably receive the cosmetic products therein, the display rails having legs with end portions configured to removably fit in the holes so that the display rails are capable of being rearranged on the surface to modify display of the cosmetic products; and a display tower provided on the display station, the display tower including a plurality of rotatable tiers, each of the tiers having at least one tower rail configured to removably receive cosmetic products therein.

19. The cosmetic display system of claim 18, wherein the display station includes at least one tray storage compartment and at least one portable tray provided in the compartment, the tray being configured for placement of cosmetic products thereon to facilitate transfer of the cosmetic products from the display station.

20. The cosmetic display system of claim 18, further comprising a plurality of cosmetic products removably mounted in the plurality of display rails.

21. The cosmetic display system of claim 20, wherein the cosmetic products are chosen from nail polish, eye shadow, foundation bottles, powder dispensers, mascara dispensers, eyeliner dispensers, eye pencils, lipsticks, lip glosses, cheek color, and concealer.

22. The cosmetic display system of claim 18, wherein the plurality of display rails include at least one rail configured to removably receive at least one of nail polish testers, eye shadow testers, foundation testers, powder dispensers, mascara dispensers, eyeliner dispensers, eye pencils, lipsticks, lip glosses, cheek color, and concealer.

23. The cosmetic display system of claim 18, further comprising lipstick testers mounted in the tower rails.

24. The cosmetic display system of claim 18, wherein each of the rotatable tiers is independently rotatable.

25. The cosmetic display system of claim 18, further comprising a product display cabinet mounted on the display station, the display cabinet having at least one wall formed of at least partially transparent material to permit viewing of objects in the display cabinet.

26. The cosmetic display station of claim 18, further comprising a cup-shaped holder mounted on the surface of the display station, the cup-shaped holder being configured to removably receive pencils therein.

27. A system for displaying cosmetic products in a retail environment, comprising:

a plurality of cosmetic products;

a display station including at least one surface having a plurality of holes therein; and a plurality of display rails configured to removably receive the cosmetic products, the display rails having legs with end portions configured to removably fit in the holes so that the display rails are capable of being rearranged on the surface to modify display of the cosmetic products.

28. The cosmetic display system of claim 27, further comprising at least one application play station at which cosmetic products removed from the display rails may be applied.

29. The cosmetic display system of claim 28, wherein said application play station includes at least one surface having a plurality of holes therein, and wherein said system further comprises at least one application station rail configured to removably receive cosmetic products, the application station rail including legs having end portions configured to removably fit in the holes in the surface of the application play station.

30. The cosmetic display system of claim 29, further comprising at least one mirror associated with the display station.

31. The cosmetic display system of claim 28, further comprising at least one portable tray configured to facilitate transfer of cosmetic products from the display station to the application play station.

32. The cosmetic display system of claim 27, wherein the plurality of cosmetic product comprise makeup products.

33. The cosmetic display system of claim 27, wherein the cosmetic products are chosen from nail polish, eye shadow, foundation bottles, powder dispensers, mascara dispensers, eyeliner dispensers, eye pencils, lipsticks, lip glosses, cheek colors, and concealer.

34. The cosmetic display station of claim 27, wherein the cosmetic products comprise cosmetic testers.

35. The cosmetic display station of claim 27, further comprising a product display cabinet provided on the display station, the product display cabinet having at least one wall formed of at least partially transparent material to permit viewing of objects in the display cabinet.

* * * * *